US010941996B2

(12) United States Patent
Thomas et al.

(10) Patent No.: US 10,941,996 B2
(45) Date of Patent: Mar. 9, 2021

(54) FIREARM OBSTRUCTER AND METHODS OF OPERATING SAME

(71) Applicant: SHUT-LOK LIMITED, Wigan (GB)

(72) Inventors: Roy Thomas, Wigan (GB); John David Tradewell, Scarborough (GB)

( * ) Notice: Subject to any disclaimer, the term of this patent is extended or adjusted under 35 U.S.C. 154(b) by 0 days.

(21) Appl. No.: 16/633,058

(22) PCT Filed: Jul. 25, 2018

(86) PCT No.: PCT/GB2018/052090

§ 371 (c)(1),
(2) Date: Jan. 22, 2020

(87) PCT Pub. No.: WO2019/020996

PCT Pub. Date: Jan. 31, 2019

(65) Prior Publication Data

US 2020/0173747 A1 Jun. 4, 2020

(30) Foreign Application Priority Data

Jul. 25, 2017 (GB) ..... 1711989

(51) Int. Cl.
*F41A 17/44* (2006.01)

(52) U.S. Cl.
CPC ..... *F41A 17/44* (2013.01)

(58) Field of Classification Search
CPC ..... F41A 17/44
USPC ..... 42/70.01, 70.11
See application file for complete search history.

(56) References Cited

U.S. PATENT DOCUMENTS 3,154,874 A * 11/1964 Stewart ..... F41A 17/44 42/70.11
5,699,687 A 12/1997 Pittman
6,584,718 B1 7/2003 Serrao
2010/0263253 A1 10/2010 Giebel et al.
2014/0060129 A1 3/2014 Daniels

FOREIGN PATENT DOCUMENTS

DE 10231685 12/2010

OTHER PUBLICATIONS

International Search Report for International Patent Application No. PCT/GB2018/052090 dated Sep. 28, 2018, European Patent Office.

* cited by examiner

*Primary Examiner* — Reginald S Tillman, Jr.
(74) *Attorney, Agent, or Firm* — Trego, Hines & Ladenheim, PLLC

(57) ABSTRACT

A firearm obstructer (100) for obstructing a passage (200) between a chamber and a muzzle of a firearm. The firearm obstructer (100) has an arm (101) and a tapered region (105). The arm (101) moves relative to the tapered region (105) to transition the firearm obstructer (100) between locking and unlocking configurations. In the locking configuration, the firearm obstructer (100) engages with the passage (200) to hold the firearm obstructer 100 in place in the passage (200). The firearm obstructer (100) so positioned provides an obstruction in the passage (200). In the unlocking configuration, the firearm obstructer (100) is removable from the passage (200). A method of operating the same.

9 Claims, 9 Drawing Sheets

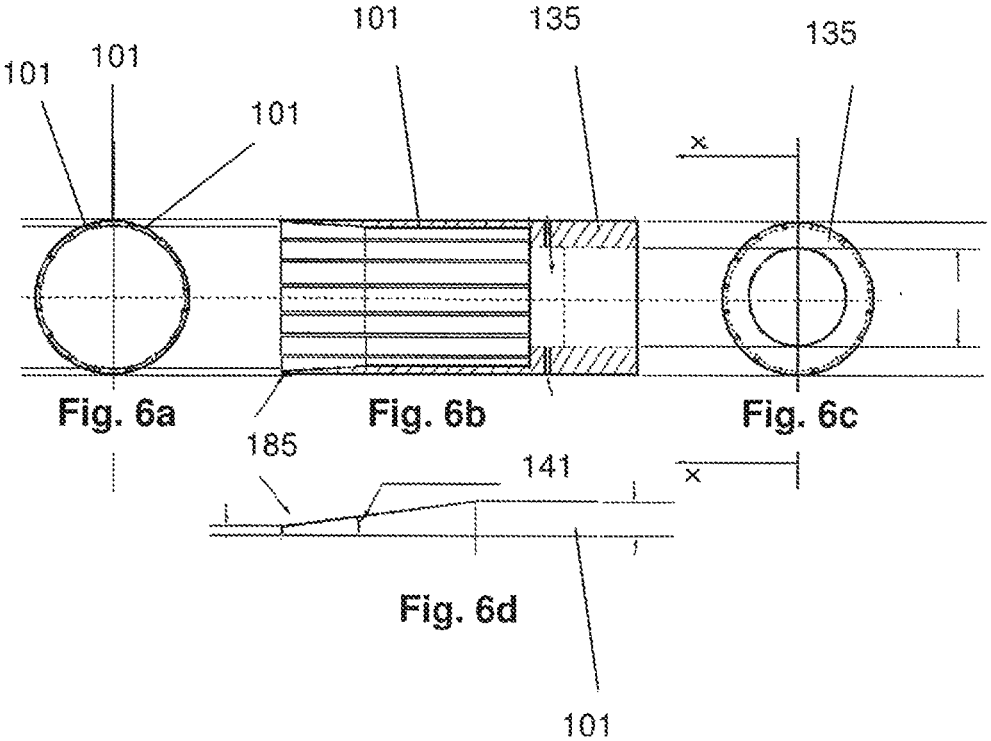
Fig. 6a Fig. 6b Fig. 6c
Fig. 6d
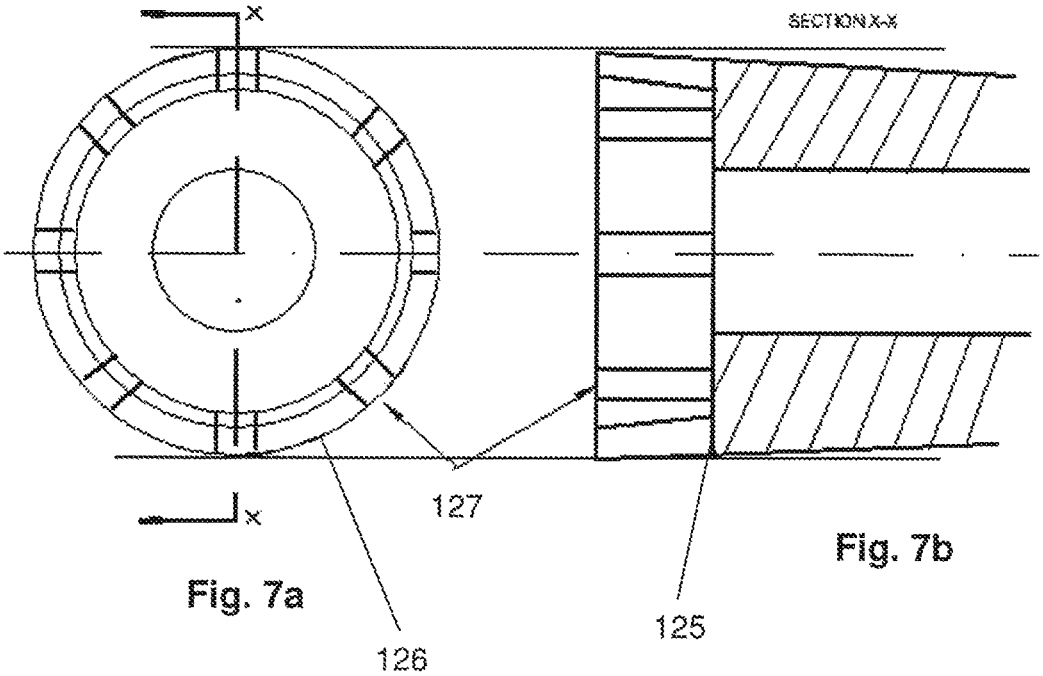
Fig. 7a Fig. 7b

FIREARM OBSTRUCTER AND METHODS OF OPERATING SAME

The present invention is directed towards a firearm obstructer and methods of operating the same. In particular, the present invention is directed towards a firearm obstructer suitable for use in obstructing a passage between a chamber and a muzzle of a firearm, and methods of operating the same.

Preventing the unauthorised use of firearms is a significant concern for firearm owners. Firearm owners may secure their equipment in safes so that they cannot be accessed, including by storing firearms and ammunition separately. Firearm owners may use locking devices to lock the trigger of the firearm in place to prevent firearm discharge.

One known firearm obstructer is disclosed in U.S. Pat. No. 5,950,344 in the name of LARRY ROSS. The firearm obstructer comprises a base that cooperates with the firearm's extractor, a pliable and expandable portion attached to the base for expanding to create an interference fit with the firearm's bore, and a compression shaft that, when rotated, will force the expandable portion outwardly to create the interference fit.

It is an aim of example embodiments to improve the ease of use and/or the security, or at least provide an alternative to, the existing devices.

Accordingly, there is provided an apparatus and method as set forth in the appended independent claims. Other features will be apparent from the dependent claims, and the description which follows.

According to a first aspect, there is provided a firearm obstructer suitable for use in obstructing a passage between a chamber and a muzzle of a firearm, the firearm obstructer comprises: an arm, and a body having a tapered region, wherein the arm is arranged to move relative to the tapered region to transition the firearm obstructer between locking and unlocking configurations, wherein in the locking configuration the firearm obstructer is arranged to engage with the passage to hold the firearm obstructer in place in the passage, and wherein the firearm obstructer so positioned provides an obstruction in the passage, and wherein in the unlocking configuration the firearm obstructer is removable from the passage.

Here, "firearm" may refer to a firearm having a barrel with an internal bore that is 'rifled'/grooved or smooth."

The firearm obstructer of the first aspect may transition between locking and unlocking configurations by the movement of an arm relative to a tapered region of the firearm obstructer. The firearm obstructer therefore does not require a compression shaft for placing an expandable portion under compression, as required by the existing device disclosed in U.S. Pat. No. 5,950,344.

The firearm obstructer may have a first end portion and a second end portion. The axial direction may be from the first end portion to the second end portion and the radial direction may be perpendicular to the axial direction. The arm may be arranged to move relative to the tapered region, in the axial direction, to transition the firearm obstructer between the locking and unlocking configuration.

The arm may be arranged to extend radially outward when transitioning from the unlocking to the locking configuration.

The first end portion may be a wide portion and the second end portion may be a narrow portion of the firearm obstructer. The narrow portion may comprise the body and the arm. In use, the narrow portion may be inserted into the passage and the wide portion may be positioned outside of the passage. The wide portion may prevent the firearm obstructer from being inserted completely into the passage.

The wide portion positioned outside of the passage may enable a firearm user to easily identify the presence of the firearm obstructer in the passage. The wide portion suitably prevents the firearm obstructer being accidentally dropped or positioned too far down the passage such that it cannot easily be retrieved. In addition, the wide portion may provide a convenient point to grasp the firearm obstructer such that it may be removed from the passage when in the unlocking configuration.

In use, the narrow portion may be inserted into a barrel of the firearm.

In use, the narrow portion may be inserted into the breech-end of the barrel of the firearm.

The wide portion may be connected to the narrow portion by a frangible connection arranged to break in response to a predetermined amount of force being applied to the wide portion, and separate the wide portion from the narrow portion such that, in use, the narrow portion may remain within the passage. The wide portion may be a cap. The wide portion may be connected to the narrow portion by adhesive.

The wide portion may separate from the narrow portion in the event that a predetermined amount of force is applied to the wide portion. A predetermined amount of force may for example be applied by an unauthorised person attempting to pull or pry the firearm obstructer out of the passage when the firearm obstructer is in the locking configuration. The wide portion is thus designed to break away from the narrow portion at the frangible connection such that the narrow portion may be left within the passage in the locking configuration, where it will be difficult to dislodge by the unauthorised person. Therefore, the frangible connection between the wide portion and the narrow portions provides a security measure for preventing unauthorised removal of the firearm obstructer.

The firearm obstructer may further comprise a locking member. In this example, rotation of the locking member may cause relative movement of the arm and the tapered region.

The firearm obstructer may be able to transition between unlocking and locking configurations by rotation of the locking member.

Rotation of the locking member in one direction may cause relative movement of the arm and the tapered region to transition the firearm obstructer to the locking configuration. Rotation of the locking member in an opposite direction may allow the firearm obstructer to transition to the unlocking configuration.

The locking member may cooperate with a key such that rotation of the key rotates the locking member. The locking member may cooperate with a key such that rotation of the locking member is only possible with the key.

The locking member may comprise a threaded shaft.

The body and the arm may have an internal aperture for receiving the threaded shaft.

The locking member may be connected to the arm so as to cause the relative movement between the arm and the tapered region. The connection between the locking member and the arm may be arranged to break in response to a predetermined amount of force being applied to the connection so as to separate the locking member from the arm.

The locking member may be connected to the arm by one or more shear pins.

The connection between the locking member and the arm is arranged to break in response to a predetermined amount of force, for example above a shearing threshold, being applied to the connection. The force may be applied as a result of an unauthorised user applying an axial force to the firearm obstructer in an attempt to dislodge the firearm obstructer from the passage when the firearm obstructer is in the locking configuration. Therefore, the connection between the locking member and the arm provides a security measure that prevents unauthorised removal of the firearm obstructer.

The firearm obstructer may further comprise an advancer. The advancer may connect the arm to the locking member. The connection between the arm and the advancer may be arranged to break in response to the predetermined amount of force being applied to the connection so as to separate the advancer from the arm.

The advancer may be connected to the arm by one or more shear pins.

The advancer may be connected to the threaded shaft.

The firearm obstructer may comprise a coupling portion from which the arm extends. In this example, the arm and coupling portion may be integrally formed, for example by comprising the same piece of material. The arm and/or coupling portion may comprise a resilient, flexible material such that extension of the arm in the radial direction takes place by elastic flexion of the arm. The arm and/or coupling portion may bend resiliently from a portion away from the free end of the arm.

The firearm obstructer may comprise a plurality of arms extending from the coupling portion. The arms may be on opposite sides of the coupling portion, or may be distributed around the radial extent of the coupling portion. The arms may be evenly distributed around the coupling portion. The arms may be carried by a base/ring. The arms may comprise a sleeve separated by a plurality of slits/cut-outs. The arms may be in the form of a collet.

The coupling portion may have a circular cross-section. The plurality of arms may extend around the circumference of the coupling portion.

The plurality of arms may define an internal aperture for receiving at least part of the tapered region. As the arms move over the tapered region, the tapered region may urge the plurality of arms outward to form the locking configuration.

The body may comprise a first body having the tapered region and a second body, wherein during normal use the second body and the first body remain at a fixed position relative to one another.

The first body may have an end portion defining an aperture sized to receive the second body. In response to a predetermined amount of force being applied to the second body, the second body may be arranged to be driven into the aperture such that the second body is at least partially retained within the aperture of the first body.

The end portion may be in the form of a collet, and wherein when the second body is driven into the aperture of the collet, the collet expands outwardly to form a locking configuration.

In the locking configuration, the outer surface of the collet may be arranged to engage the passage of the firearm to hold the firearm obstructer in position with the passage and wherein the firearm obstructer so positioned provides an obstruction in the passage.

An outer surface of the second body may be tapered, such that as the second body is driven further into the aperture of the collet, the collect expands further outwardly to form a tighter locking configuration.

The firearm obstructer may further comprise an outer casing arranged to at least partially encase the arm and the body of the firearm obstructer. The outer casing may encase the narrow portion of the firearm obstructer. Advantageously, the outer casing provides further enhancement to the locking configuration.

The outer casing may be formed of a pliant material. The outer casing advantageously may provide protection to the inner surface of the passage. The outer casing protects the passage, thereby preventing the firearm being damaged as a result of the firearm obstructer engaging with the passage.

The outer casing may be formed of polyether ether ketone (PEEK). The outer casing may be formed of aluminium or brass.

The outer casing may be a flexible non-metallic sleeve. The outer casing may be formed of rubber, a rubber composite material or other composite material.

The outer casing may be arranged to deform and expand in response to heat. The outer casing may be formed of any material capable of expanding outwards, such as in response to heat. Advantageously, the outer casing being able to deform and expand with a relatively high rate of thermal expansion in response to heat means that the firearm obstructer may form a tighter engagement with the passage in the event that heat is applied to the firearm.

The firearm obstructer may further comprise a container arranged to contain an adhesive material. The adhesive material may be of a fast setting nature that may also expand upon setting when in contact with air. The container may be arranged to rupture in response to a predetermined amount of force being applied to the container such that the adhesive contained within the container is released so as to adhesively bond the firearm obstructer in position. The container of adhesive material may provide a further security measure to prevent unauthorised use of the firearm.

The firearm obstructer may be suitable for use with a rifle, considering its external dimensions.

The firearm obstructer may be suitable for use with a shotgun, considering its external dimensions.

The firearm obstructer may be suitable for use with a handgun, considering its external dimensions.

According to a second aspect there is provided a method of operating a firearm obstructer according to the first aspect above, the method comprising: positioning the firearm obstructer within the passage between the chamber and the muzzle of the firearm while in the unlocking configuration; and moving the arm relative to the tapered region to transition the firearm obstructer from the unlocking configuration to the locking configuration.

The method may further comprise moving the arm relative to the tapered region to transition the firearm obstructer from the locking configuration to the unlocking configuration. The method may further comprise removing the firearm obstructer from the passage.

For a better understanding of the invention, and to show how embodiments of the same may be carried into effect, reference will now be made, by way of example only, to the accompanying diagrammatic drawings in which.

Figure 8:
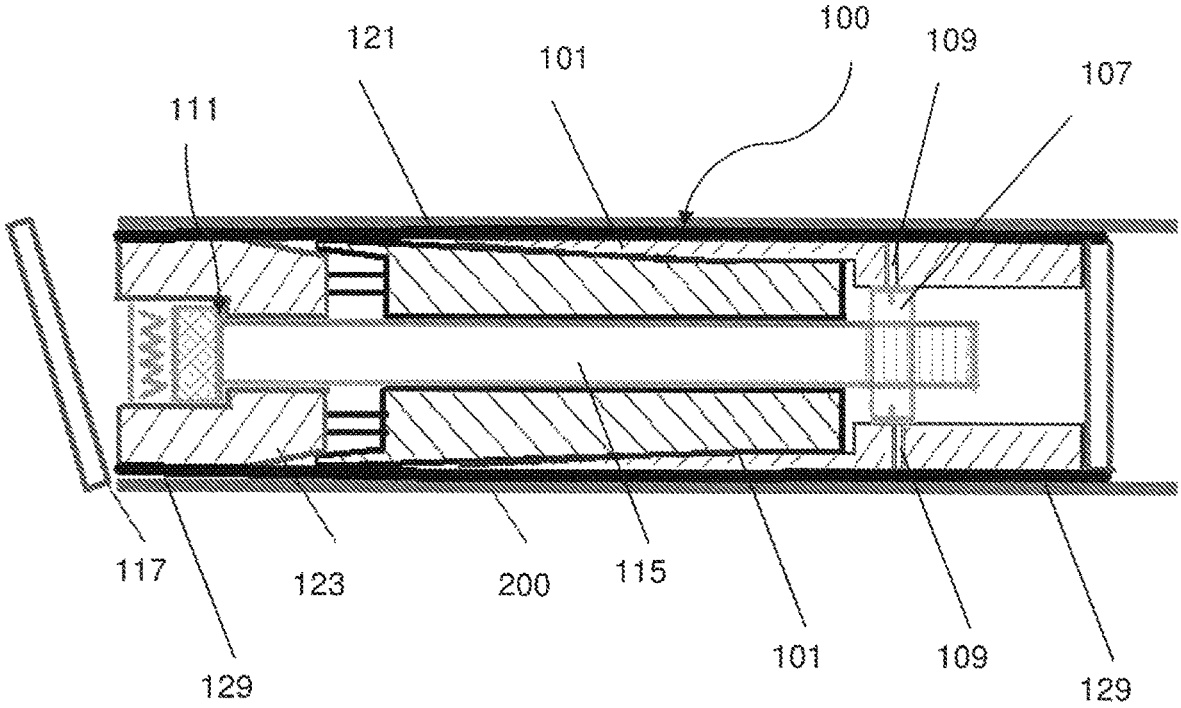
Figure 9:
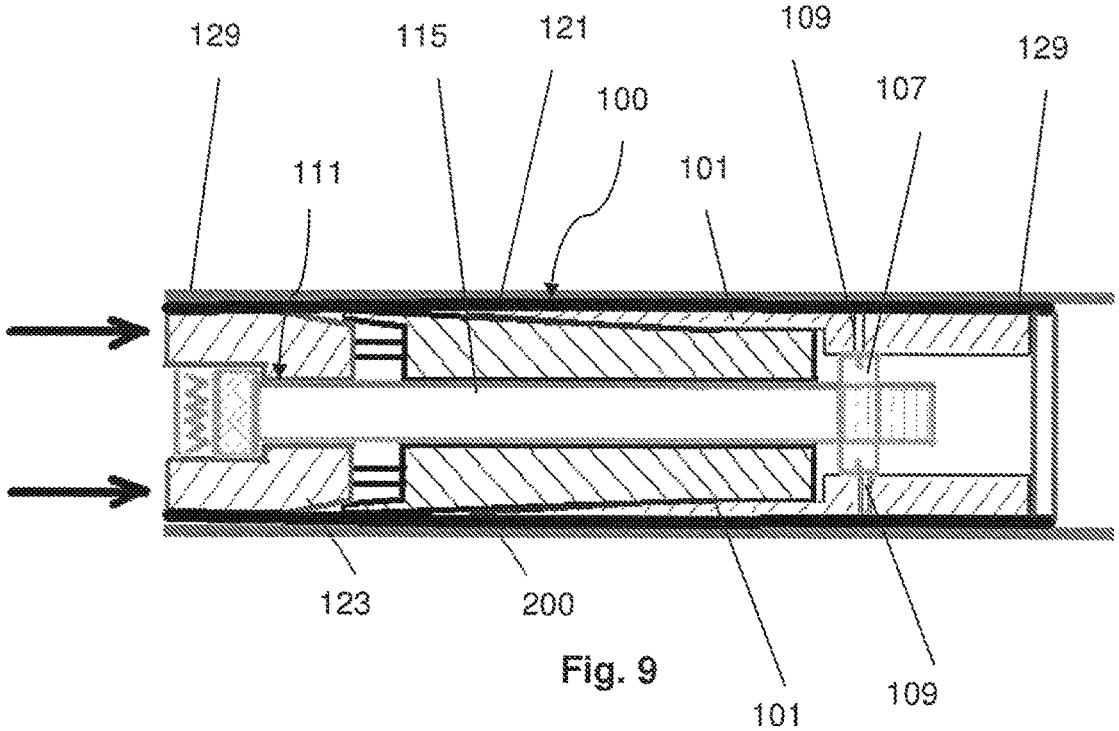
Figure 10:
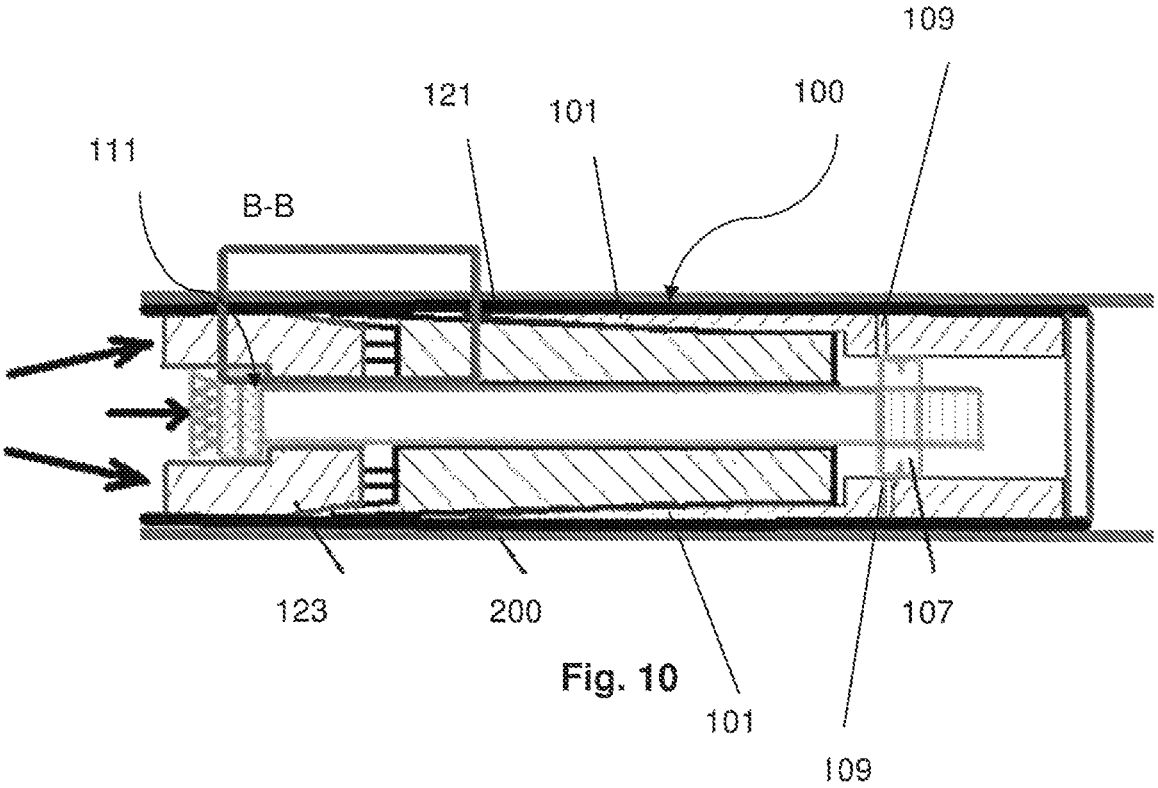
Figure 11:
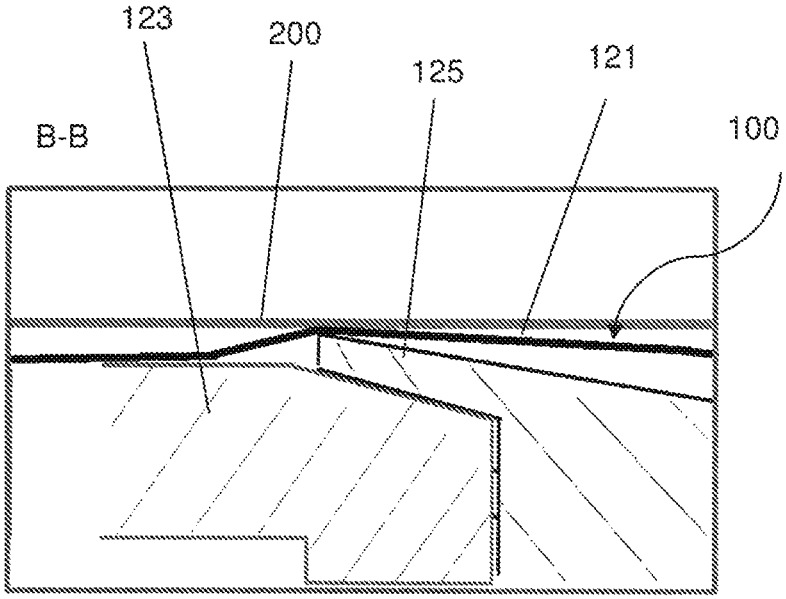
Figure 12:
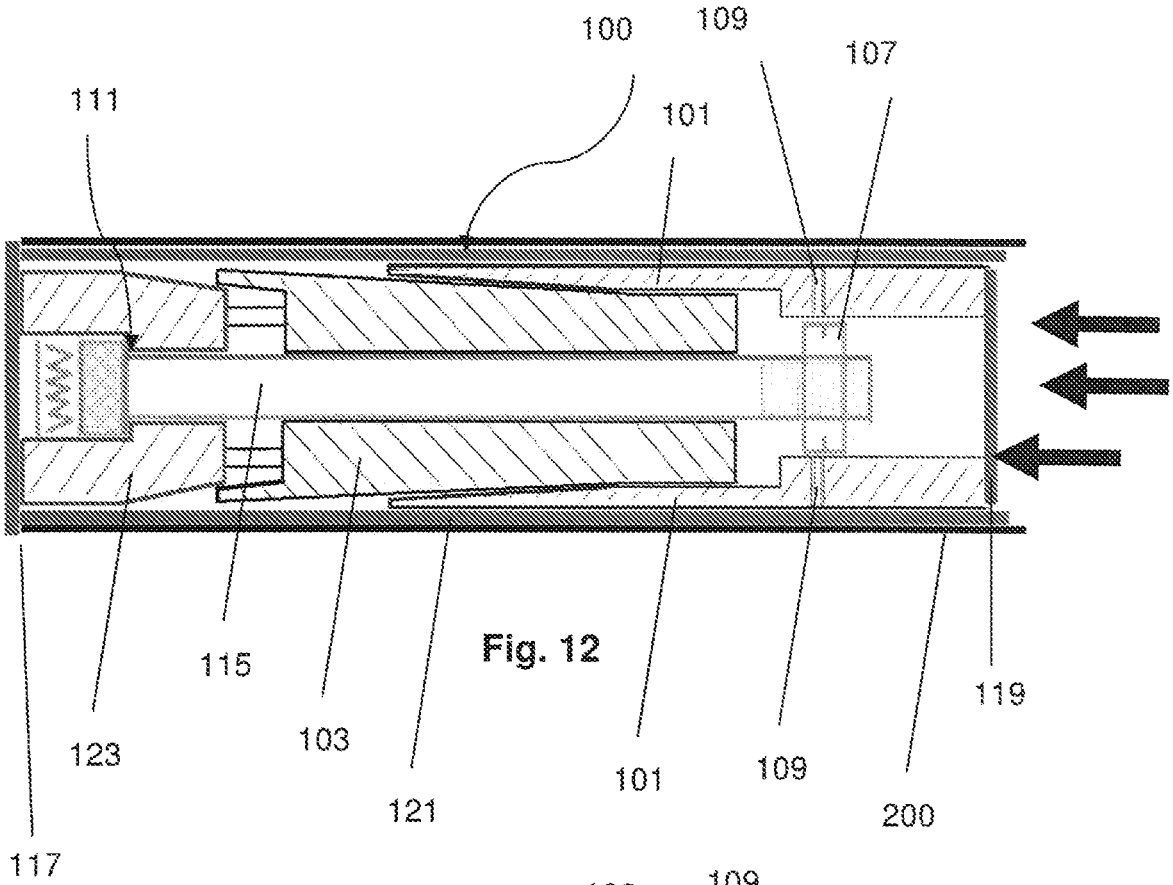
Figure 13:
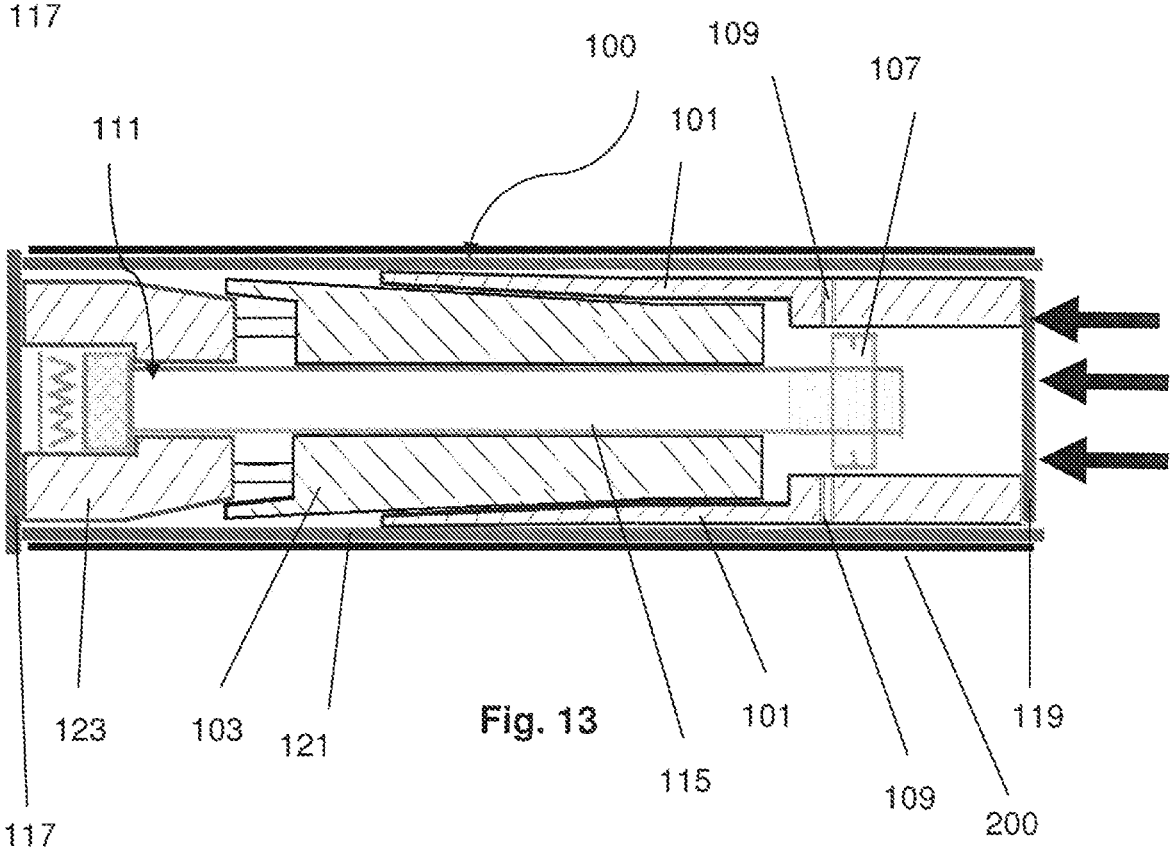
Figure 14:
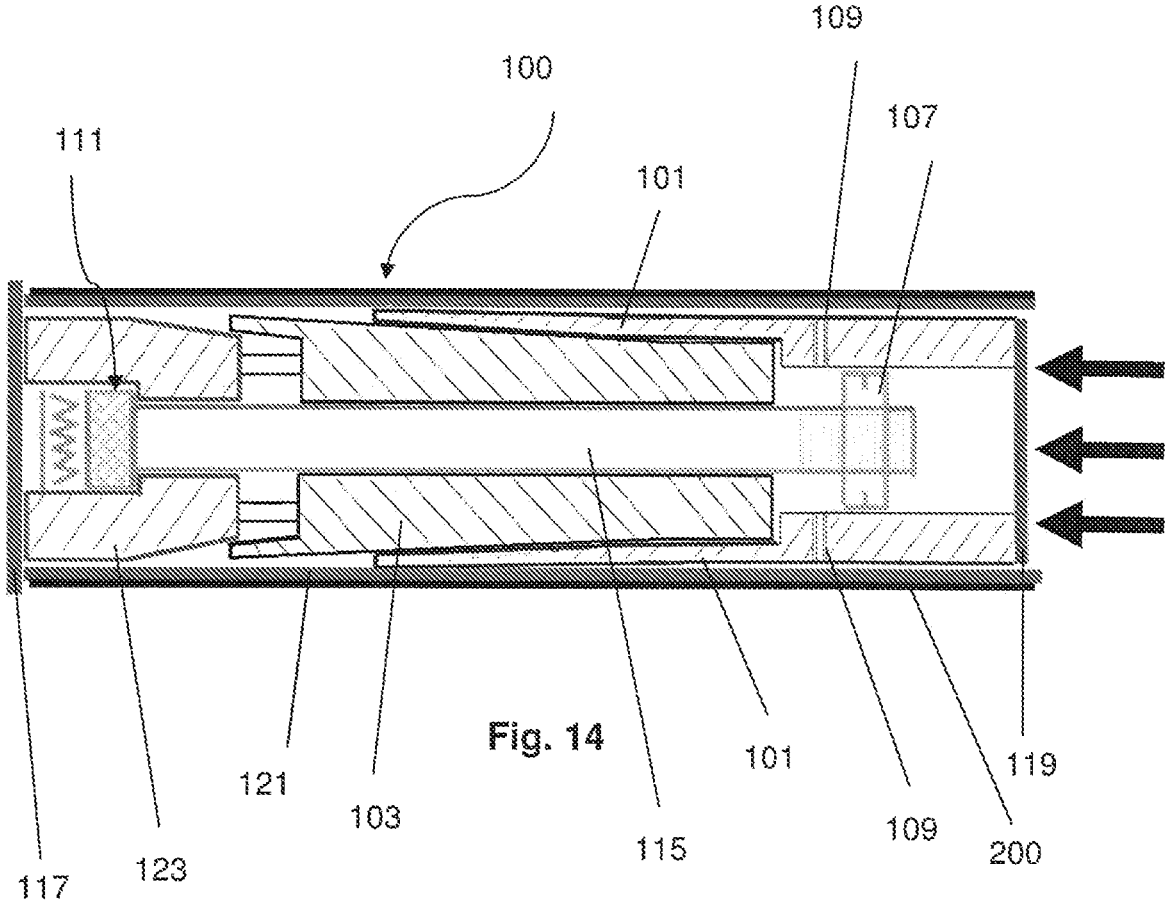
Figure 15:
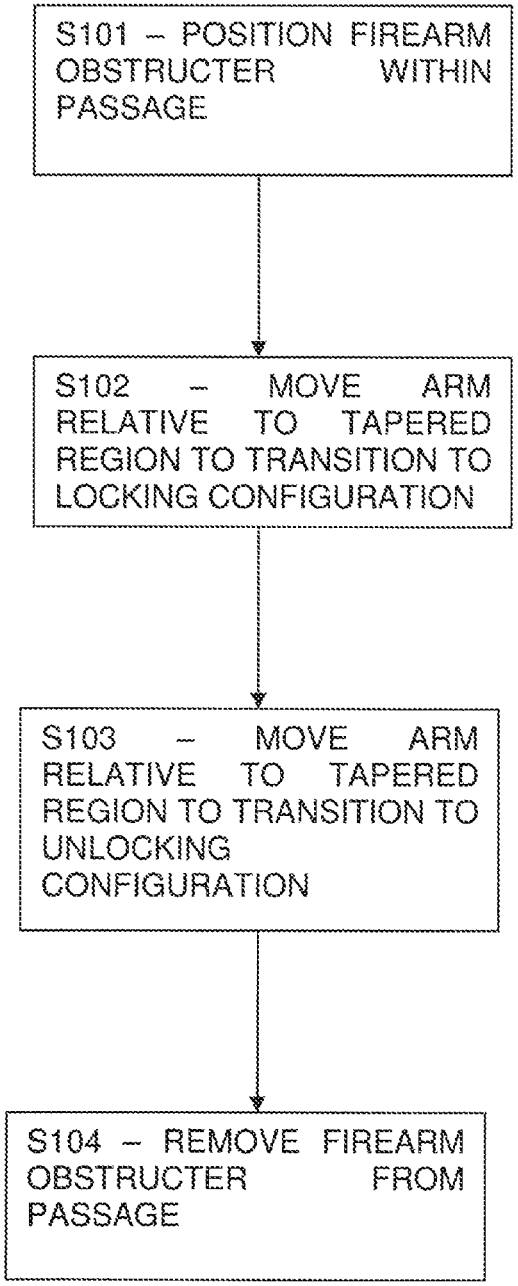

FIGS. 6*a*-6*d* show schematic views of an arm and coupling portion of an example firearm obstructer;

FIGS. 7*a*-7*b* show schematic views of an first body of an example firearm obstructer;

FIGS. 8-10 show sectional views of an example firearm obstructer during an attempted removal of the firearm obstructer from the passage by an unauthorised person;

FIG. 11 shows a detailed view of section B-B of the firearm obstructer in FIG. 10;

FIGS. 12-14 show sectional views of an example firearm obstructer during an attempted removal of the firearm obstructer from the passage by an unauthorised person; and FIG. 15 shows an example method of operating a firearm obstructer according to an example embodiment.

Figure 1:
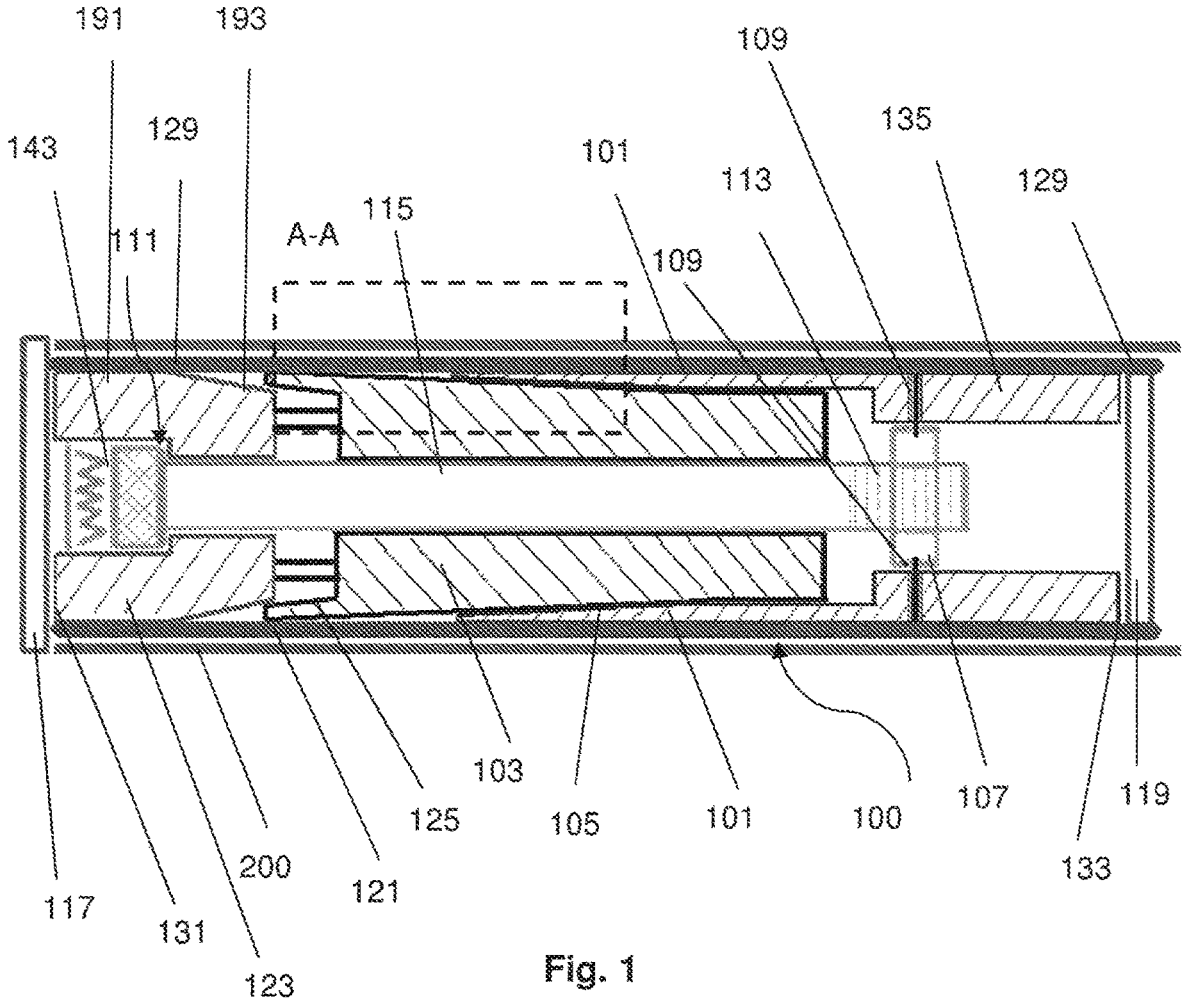
FIG. 1 shows a sectional view of an example firearm obstructer according to an example embodiment.

Referring to FIG. 1 there is shown an example firearm obstructer indicated generally by the reference numeral 100. The firearm obstructer 100 comprises an arm 101, and a body 103 having a tapered region 105. The arm 101 is arranged to move relative to the tapered region 105 to transition the firearm obstructer 100 between locking and unlocking configurations.

The firearm obstructer 100 is positioned in the passage 200 between the chamber and the muzzle of a firearm and in this particular example is positioned in the breech-end of the barrel 200 of the firearm. Firearm obstructers 100 according to other example embodiments may be positioned in the chamber or the muzzle of the firearm, with corresponding changes to dimensions but the same mode of operation. It is, however, generally expected that the firearm obstructer 100 will be positioned in the breech-end of the barrel 200 of the firearm, so as to prevent a projectile being loaded into and subsequently discharged from the firearm.

The firearm obstructer 100 is shown in the unlocking configuration, in which the firearm obstructer 100 is removable from the passage 200. In the locking configuration, the firearm obstructer 100 engages with the passage 200 to hold the firearm obstructer 100 in place in the passage. In this way, the firearm obstructer 100 obstructs the passage 200 between the chamber and the muzzle of the firearm, thereby preventing the discharge of the firearm.

An operation of the example firearm obstructer 100 shown in FIG. 1 will now be explained with reference to FIGS. 1, 2 and 3.

In operation, the firearm obstructer 100 is positioned in the passage 200 between the chamber and the muzzle of the firearm. The firearm obstructer 100 is initially in the unlocking configuration as shown in FIG. 1.

The user transitions the firearm obstructer 100 to the locking configuration by moving the arm 101 relative to the tapered region 105.

Figure 2:
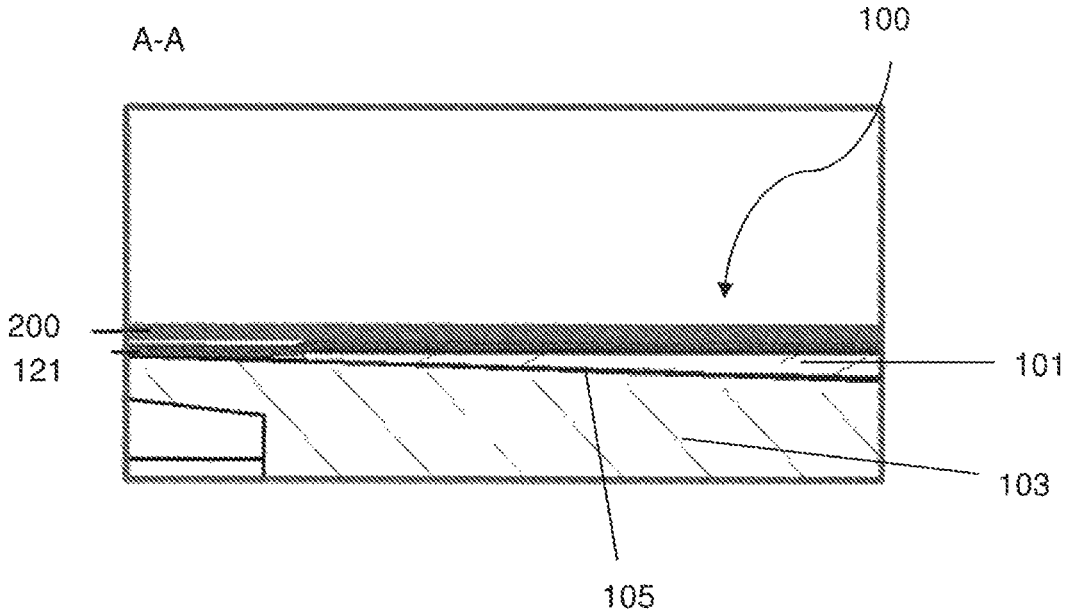
FIG. 2 shows a detailed view of section A-A of the firearm obstructer in FIG. 1 when the firearm obstructer is transitioning to the locking configuration.

Referring to FIG. 2, there is shown the firearm obstructer 100 transitioning to the locking configuration. Here, the arm 101 has moved towards the body 103 in the axial direction as compared to the unlocking configuration shown in FIG. 1. The movement towards the body 103 moves the arm 101 over the tapered region 105 which moves the arm 101 outwards in the radial direction. The radial outward movement of the arm 101 places the arm 101 in engagement with the passage 200.

Figure 3:
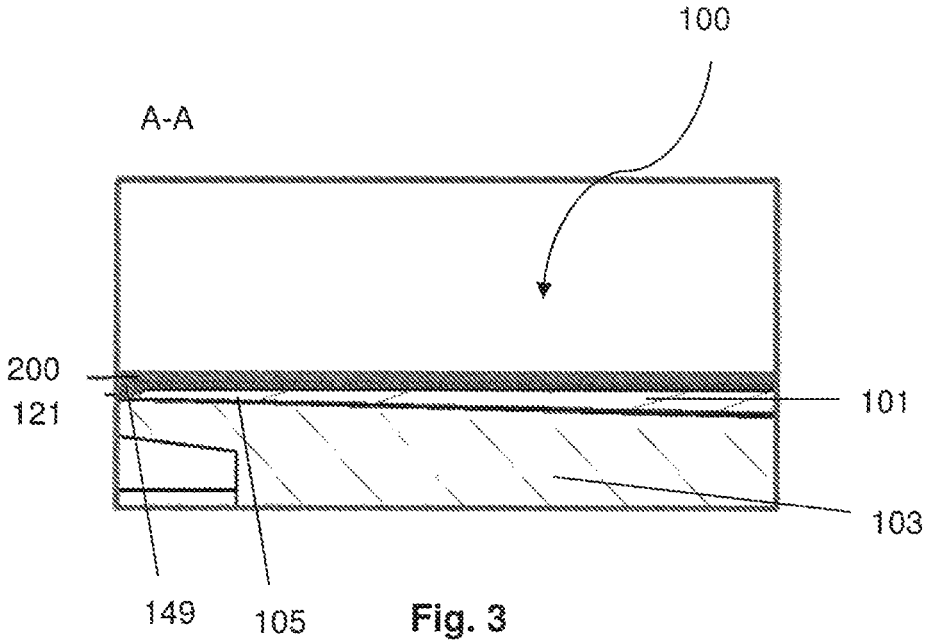
FIG. 3 shows a detailed view of section A-A of the firearm obstructer in FIG. 1 when the firearm obstructer is in the locking configuration.

Referring to FIG. 3, there is shown the firearm obstructer 100 in the locking configuration. Here, the arm 101 has moved further axially towards the body 103 as compared to FIG. 2. As a result, the arm 101 has been moved further radially outwards and into further engagement with the passage 200. In this way, the firearm obstructer 100 obstructs the passage 200 between the chamber and the muzzle of the firearm, thereby preventing the discharge of the firearm, and as described in greater detail below is held in place so that unauthorised removal is prevented.

Referring again to FIG. 1, the firearm obstructer 100 has a first end portion 117 and a second end portion 129. The axial direction is from the first end portion 117 to the second end portion 129 and the radial direction is perpendicular to the axial direction. The arm 101 is arranged to move relative to the tapered region 105 in the axial direction to transition the firearm obstructer 100 between the locking and unlocking configurations.

The first end portion 117 is a wide portion 117. The second end portion 129 is a narrow portion 129. The wide portion 117 is wider than the diameter of the passage 200. In use, the narrow portion 129 is inserted into the passage 200 of the firearm and the wide portion 117 is positioned outside of the passage 200 of the firearm. The wide portion 117 is in the form of an end cap 117.

Figure 4:
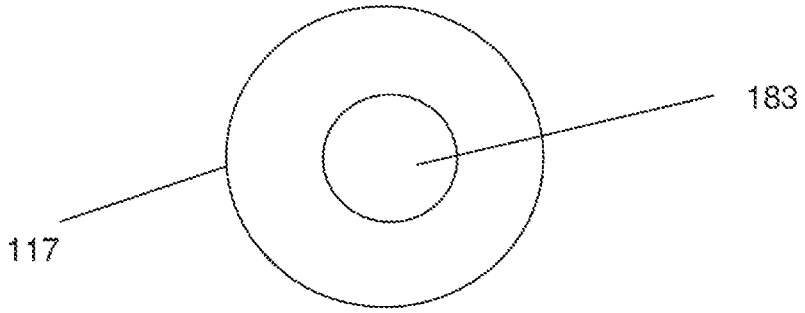
FIG. 4 shows a schematic view of a wide portion end cap of an example firearm obstructer.

Referring to FIG. 4, there is shown an example end cap 117. The end cap 117 is in the form of a disc and has a central aperture 183. The aperture 183 may be used to enable a key to access a lock of the firearm obstructer 100. The lock is discussed in greater detail below.

Referring again to FIG. 1, the narrow portion 129 has a first end 131 and a second end 133. The first end 131 of the narrow portion 129 is connected to the wide portion 117 and the second end 133 of the narrow portion 129 is connected to an end cap 119. The end cap 119 is fixedly attached to the rest of the narrow portion 129 such as by being bolted to the rest of the narrow portion 129. The end cap 119 acts to prevent access to the internal components of the firearm obstructer 100.

Figure 5:
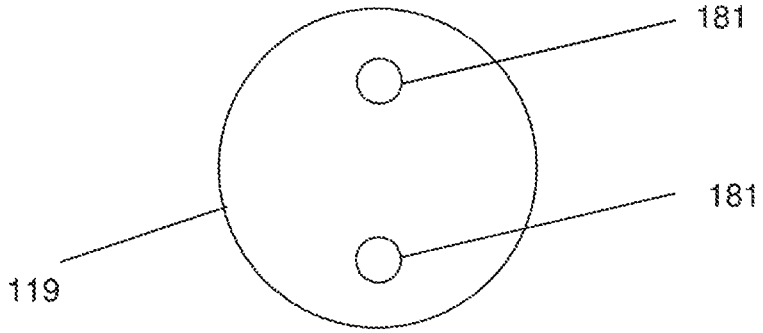
FIG. 5 shows a schematic view of a narrow portion end cap of an example firearm obstructer.

Referring to FIG. 5, there is shown an example end cap 119. The end cap 119 is in the form of a disc and has two apertures 181 through which bolts may be received for fastening the end cap 119 to the rest of the narrow portion 129.

Referring again to FIG. 1, the wide portion 117 is connected to the narrow portion 129 by a frangible connection arranged to break in response to a predetermined amount of force being applied to the wide portion 117. This means that if a force equal to or in excess of the predetermined amount of force is applied to the wide portion 117, the frangible connection breaks.

As a result of the frangible connection breaking, the wide portion 117 is separated from narrow portion 129. The predetermined amount of force may be selected to be sufficiently high to prevent accidental removal of the wide portion 117. In addition, the predetermined amount of force may be selected such that the connection between the wide portion 117 and the narrow portion 129 breaks before sufficient force is applied to the firearm obstructer 100 to remove it from the passage 200 when in the locking configuration.

The frangible connection may be provided by using an adhesive to bond the wide portion 117 to the narrow portion 129.

This arrangement means that if, in use, an unauthorised user pulls on the wide portion 117, in an attempt to pull the firearm obstructer 100 out of the passage 200, the wide portion 117 will separate from the narrow portion 129. The narrow portion 129 will remain within the passage 200 meaning that there is no part of the firearm obstructer 100 extending out of the passage 200 that could be used to attempt to pull or pry the firearm obstructer 100 out of the passage 200.

The mechanism by which relative movement of the tapered region 105 and the arm 101 transitions the firearm obstructer 100 between the locking and unlocking configurations will now be described with reference to FIG. 1.

The tapered region 105 of the body 103 is tapered in the axial direction such that the width of the tapered region 105 increases in the direction from the second end 133 of the narrow portion 129 to the first end 131 of the narrow portion 129. The body 103 is generally cone-shaped and has an internal aperture running from one end to the other.

At least part of the tapered region 105 is received within an internal aperture defined by the arm 101.

In operation, as the arm 101 moves relative to the tapered region 105, the arm 101 moves over the tapered region 105 and is in contact with the tapered region 105. If the arm 101 moves axially towards the first end 131 of the narrow portion 129 then the arm 101 is urged outwardly in the radial direction due to the direction of taper of the tapered region 105. By contrast, if the arm 101 moves axially towards the second end 133 of the narrow portion 129 the arm 101 moves radially inwards.

The firearm obstructer 100 further comprises a locking member indicated generally by the reference numeral 111. The movement of the arm 101 relative to the tapered region 105 is caused by the locking member 111. The locking member 111 is rotatable, and this rotation of the locking member 111 causes the arm 101 to move relative to the tapered region 105.

The locking member 111 comprises a lock 143 and a threaded shaft 115. The threaded shaft 115 is arranged to extend from the first end 131 of the narrow portion 129 towards the second end 133 of the narrow portion 129. The threaded shaft 115 is received within the internal aperture of the arm 101 and the body 103. FIG. 1 only shows a simplified form of the lock, but the skilled person will appreciate that a multi-pin lock could be used in place of the simplified lock 143 shown in FIG. 1.

The lock 143 is configured to receive a key (not shown). The locking member 111 may cooperate with the key such that rotation of the key rotates the locking member 111. In order to ensure that an ideal operational locking force is provided, the key may be angled and incorporate a torque limiter. The torque limiter may be pre-set at manufacture.

The threaded shaft 115 has a threaded region 113. The locking member 111 further comprises an advancer 107 that is connected to the threaded region 113 of the threaded shaft 115 and is connected to the arm 101. The advancer 107 acts to connect the arm 101 to the locking member 111 such that rotation of the locking member 111 effects movement of the arm 101 relative to the tapered region 105.

In use, the firearm obstructer 100 is positioned in the passage 200 while in the unlocking configuration.

The key is inserted into the lock 143 and rotated.

Rotation of the key in the lock 143 causes the threaded shaft 115 to rotate.

Rotation of the threaded shaft 115 draws the advancer 107 along the threaded shaft 115. With this motion, the arm 101 impinges on and moves over the tapered region 105, and the arm 101 moves radially outwardly.

If the key is rotated clockwise, for example, the threaded shaft 115 is caused to rotate, and this rotation causes the advancer 107 to move along the threaded shaft 115 in a direction towards to the first end 131 of the narrow portion 129. The movement of the advancer 107 causes the arm 101 to move over the tapered region 105 in a direction towards the first end 131 of the narrow portion 129. The tapered region 105 widens in the direction towards the first end 131 of the narrow portion 129. Continued rotation of the key in this direction causes the arm 101 to move radially outwards into engagement with the passage 200 in which the firearm obstructer 100 is located. By selecting the amount of key rotation, the amount of pressure between the arms 135 and the material of the passage 200 (e.g. the barrel of the firearm) can be controlled.

To transition back to the unlocking configuration, the key is rotated counter-clockwise, for example, and the advancer 107 moves away from the first end 131 and towards the second end 133 of the narrow portion 129. The movement of the advancer 107 causes the arm 101 to move in a direction towards the second end 133 of the narrow portion 129. The tapered region 105 narrows in the direction towards the second end 133 of the narrow portion 129. Continued rotation in this sense causes the arm 101 to be moved from the locking configuration to the unlocking configuration, so that the firearm obstructer 100 can be removed from the passage 200.

In both cases the key is removed from the firearm obstructer 100 after rotation is completed, preventing further rotation of the firearm obstructer 100.

The firearm obstructer 100 comprises a coupling portion 135 from which the arm 101 extends. The coupling portion 135 is integrally formed with the arm 101 in the example of FIG. 1. The coupling portion 135 may be considered as an extension of, or more generally a part of the arm 101.

In this example, the arm 101 is a plurality of arms 101. Two of the arms 101 are visible in FIG. 1. The present invention is not limited to any particular number of arms 101 in the firearm obstructer 100. The skilled person will appreciate that the firearm obstructer 100 may have one arm 101, two arms 101, or three or more arms 101. The arms 101 may comprise a sleeve separated by a plurality of slits/cut-outs. The particular number of arms 101 can be selected as desired.

The arms 101 and/or coupling portion 135 comprise a resilient, flexible material such that extension of the arms 101 in the radial direction takes place by elastic flexion of the arms 101. The arms 101 and/or coupling portion 135 may bend resiliently from a portion away from the free end of the arm 101.

Referring to FIGS. 6*a*-6*d*, there is shown one example arrangement of the arms 101 and coupling portion 135.

Referring to FIG. 6*b*, the plurality of arms 101 extend from the coupling portion 135 in the axial direction.

Referring to FIG. 6*c*, the coupling portion 135 has an annular cross-section.

Referring to FIG. 6*a*, the plurality of arms 101 extend around the circumference of the coupling portion 135. There are sixteen such arms 101 shown in FIG. 6*a* but the present invention is not limited to any particular number of arms 101.

Referring to FIGS. 6*a*-6*c*, the coupling portion 135 and arms 101 define an internal aperture. The arms 101 and coupling portion 135 of FIGS. 4*a*-4*d* therefore effectively form a lantern-ring.

Referring to FIGS. 6*b* and 6*d*, the end portions 141 of the arms 101 are tapered in the axial direction such that the tips 185 of the arms 101 are the narrowest points of the arms 101. The tapered surface 141 of the arms 101 face the tapered region 105 (FIG. 1).

Referring again to FIG. 1, the advancer 107 is connected to the arm 101 by one or more shear pins 109. The shear pins 109 connect the advancer 107 to the coupling portion 135. The shear pins 109 are arranged to break in response to a predetermined amount of shear force being applied to the connection. The shear pins 109 breaking results in the locking member 111 being separated from the arm 101 because, in this example, the advancer 107 is no longer connected to the coupling 135. As a result, rotation of the locking member 111 is not able to cause movement of the arm 101.

Significantly, the connection between the locking member 111 and the arm 101 is arranged to break in response to a predetermined amount of shear force being applied to the connection. The shear force may be applied as a result of an unauthorised user applying a percussive force to the firearm obstructer 100 in an attempt to dislodge the firearm obstructer 100 from the passage 200 when the firearm obstructer 100 is in the locking configuration. Therefore, the breakable connection between the locking member 111 and the arm 101 provides a security measure that prevents unauthorised removal of the firearm obstructer 100.

The body 103 comprises a first body 103 having the tapered region 105 and a second body 123.

The first body 103 has an end portion 125 that defines an aperture sized to receive the second body 123. During normal use, the second body 123 is separated from and not directly contacting the first body 103. The second body 123 normally remains at a fixed distance relative to the first body 103.

Referring to FIGS. 7*a* and 7*b*, the end portion 125 of the first body 103 is in the form of a collet 125. The collet 125 forms a collar around the aperture of the first body 103. The collet 125 has a plurality of arms 126 positioned around the circumference of the aperture and separated by slits 127. The plurality of arms 126 are tapered in the axial direction. The taper extends in the same direction as the tapered region 105.

Referring again to FIG. 1, the second body 123 has a first region 191 and a tapered region 193. The first region 191 and the tapered region 193 both have an internal aperture.

During normal use, the second body 123 and the first body 103 remain at a fixed position relative to one another.

In response to a predetermined amount of force being applied to the second body 123, the second body 123 is arranged to be driven into the aperture of the collet 125 such that the second body 123 is at least partially retained within the aperture of the collet 125. The second body 123 being driven into the first body 103 acts to expand the collet 125 outwardly in the radial direction to form a locking configuration. In this locking configuration, the collet 125 engages the passage 200 to hold the firearm obstructer 100 in position with the passage 200. The firearm obstructer 100 so positioned provides an obstruction in the passage 200.

The outer surface of the second body 123 is tapered due to tapered region 193. As the second body 123 is driven further into the aperture of the collet 125, the collet 125 expands further outwardly to form a tighter locking configuration.

The firearm obstructer 100 further comprises an outer casing 121 arranged to at least partially encase the arm 101 and the body 103 of the firearm obstructer 100. In this example, the outer casing 121 entirely encases the narrow portion 129 of the firearm obstructer 100.

The outer casing 121 is formed of a pliant material so as to provide protection to the inner surface of the passage 200. The outer casing 121 protects the passage 200, thereby preventing the firearm from being damaged as a result of the firearm obstructer 100 engaging with the passage 200.

The outer casing 121 provides further enhancement to the locking configuration. In particular, and as shown in FIG. 3, in the locking configuration, the outer casing 121 forms a 'bow-wave' of material 149 at the ends of the arms 101 as shown in FIG. 3. This 'bow-wave' effect provides additional resistance against an attempted removal of the firearm obstructer 100 by force.

The outer casing 121 is a flexible non-metallic sleeve. The outer casing 121 is formed of rubber or a composite material.

The outer casing 121 is constructed from a material that is arranged to deform and expand in response to heat. As a result the firearm obstructer 100 may form a tighter engagement with the passage 200 in the event that heat is applied to the firearm.

An operation whereby an unauthorised user attempts to remove the firearm obstructer 100 from the passage 200 by force when in the locking configuration will now be explained with reference to FIGS. 8 to 11. The firearm obstructer 100 of FIGS. 8 to 11 is the same as the firearm obstructer 100 of FIG. 1. The same reference numerals have been used for convenience.

In this example, the unauthorised user is attempting to remove the firearm obstructer 100 via the breech end of the barrel in which the firearm obstructer 100 is positioned.

Initially, the unauthorised user may attempt to remove the firearm obstructer 100 by pulling or prying the wide portion 117 of the firearm obstructer 100.

Referring to FIG. 8, there is shown an arrangement of the firearm obstructer 100 as a result of an unauthorised user attempting to pull or pry the firearm obstructer 100 out of the passage 200. Here it is shown that the wide portion 117 has separated from the narrow portion 129 of the firearm obstructer 100. This is because the connection between the wide portion 117 and the narrow portion 129 is arranged to break in response to a predetermined amount of force as explained previously.

As a result of the wide portion 117 separating from the narrow portion 129 of the firearm obstructer 100, it will be difficult for the unauthorised user to attempt to pull the firearm obstructer 100 out of the passage 200 because the narrow portion 129 is disposed inside the passage 200. Instead, the unauthorised user may attempt to apply an axial force to the firearm obstructer 100 in an attempt to dislodge the firearm obstructer 100 from the passage 200. An example application of a axial, percussive, force to the first end 131 of the narrow portion 129 is shown by the directional arrows included in FIG. 9.

As shown in FIG. 10, the application of the axial force results in the shear pins 109 breaking. This separates the locking member from the arm 101, and as such, the locking member 111 is unable to cause movement of the arm 101 to transition the arm 101 out of the locking configuration. In addition, the axial force results in the second body 123 being drive into the aperture of the collet 125 such that the collet 125 expands outwardly to engage the passage 200. The collet 125 engaging the passage 200 is shown in FIG. 11. This essentially forms a second locking configuration for the firearm obstructer 100 such that the firearm obstructer 100 is held in an even securer position with the passage 200.

Another operation whereby an unauthorised user attempts to remove the firearm obstructer 100 from the passage 200 by force when in the locking configuration will now be explained with reference to FIGS. 12 to 14. The firearm obstructer 100 of FIGS. 12 to 14 is the same as the firearm obstructer 100 of FIG. 1. The same reference numerals have been used for convenience.

In this example, the unauthorised user is attempting to remove the firearm obstructer 100 via the muzzle end of the barrel. The firearm obstructer 100 is positioned in the breech end of the barrel. The unauthorised user may place an object in the muzzle end of the barrel and use this object to apply a force to the firearm obstructer 100 in an attempt to dislodge the firearm obstructer 100. The application of the force, for example a percussive force, is indicated by the directional arrows in FIG. 12.

As shown in FIG. 13, the application of the percussive force results in the shear pins 109 breaking. This separates the locking member 111 from the arm 101, and as such, the locking member 111 is unable to cause movement of the arm 101 to transition the arm 101 out of the locking configuration.

As shown in FIG. 14, the application of further axial force after the shear pins 109 break results in the arm 101 being driven further towards the body 103 in the axial direction. This results in the arm 101 moving further outwards in the radial direction so as to form a tighter engagement with the passage 200. As a result, the firearm obstructer 100 is held in an even securer position with the passage 200.

It will be appreciated that the firearm obstructer 100 of the first aspect may prevent unauthorised attempts to remove the firearm obstructer 100 from one or both ends of the firearm (e.g. breech-end and/or muzzle end).

It will further be appreciated that both operations explained above in which an unauthorised user attempts to remove the firearm obstructer 100 will result in the firearm being essentially non-operational as the firearm obstructer 100 is held in a tight engagement with the passage 200. Further attempts to remove the firearm obstructer 100 from the passage 200 by applying a axial force to either end of the firearm obstructer 100 will only result in the firearm obstructer 100 being driven into even tighter engagement with the passage 200.

The firearm obstructer 100 may further comprise a container (not shown) arranged to contain an adhesive material. The container is arranged to rupture in response to a predetermined amount of force being applied to the container such that the adhesive contained within the container is released so as to adhesively bond the firearm obstructer 100 in position. The container of adhesive material provides a further security measure to prevent unauthorised use of the firearm.

The firearm obstructer 100 may have a length that is similar to that of a typical projectile/ammunition round for the firearm that the firearm obstructer 100 is intended to be used with. For example, in the case of a 12-bore shotgun, the typical overall length of the firearm obstructer 100 would be approximately 7 cm. In the case of a contemporary current military or police firearm ammunition round, the typical overall length would be between 2.5 cm and 5 cm. It will be appreciated that the length of the firearm obstructer 100 will be dependent on the firearm for which the firearm obstructer 100 is intended to be used with. The firearm obstructer 100 may have a length less than or equal to 7 cm.

The narrow portion 129 of the firearm obstructer 100 may have a diameter that is similar to that of a typical projectile/ammunition round for the firearm that the firearm obstructer 100 is intended to be used with. It will be appreciated that the diameter of the narrow portion 129 of the firearm obstructer 100 will be dependent on the firearm for which the firearm obstructer 100 is intended to be used with. For example, in the case of a 12-bore shotgun, the typical diameter of the narrow portion 129 of the firearm obstructer 100 when in the locking configuration would be approximately 2 cm. The narrow portion 129 of the firearm obstructer 100 may have a diameter of less than or equal to 2 cm when in the locking configuration.

The wide portion 117 of the firearm obstructer 100 may have a diameter slightly larger than the diameter of a typical projectile/ammunition round that the firearm obstructer 100 is intended to be used with. The diameter of the wide portion 117 may be minimally sufficient to prevent the device from totally entering the breech of the firearm, for example. In one example case where the firearm is a 12-bore shotgun, the diameter of the wide portion 117, the diameter is approximately 0.14 mm greater than the diameter of the narrow portion 129 when the narrow portion 129 is in the locking configuration.

Referring to FIG. 15, there is shown a method according to the second aspect for operating the firearm obstructer 100.

In step 101, the firearm obstructer 100 is positioned within the passage 200 between the chamber and the muzzle of the firearm while in the unlocking configuration.

In step 102, the arm 101 is moved relative to the tapered region 105 to transition the firearm obstructer 100 from the unlocking configuration to the locking configuration. As a result, of step 102, the firearm obstructer 100 is securely positioned within the passage 200 such that the firearm obstructer 100 obstructs the passage 200.

In step 103, in order to remove the firearm obstructer 100 from the passage 200, the arm 101 is moved relative to the tapered region 105 to transition the firearm obstructer 100 from the locking configuration to the unlocking configuration.

In step 104, the firearm obstructer 100 is removed from the passage 200.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

In summary, there is provided a firearm obstructer 100 for obstructing a passage 200 between a chamber and a muzzle of a firearm. The firearm obstructer 100 has an arm 101 and a tapered region 105. The arm 101 moves relative to the tapered region 105 to transition the firearm obstructer 100 between locking and unlocking configurations. In the locking configuration, the firearm obstructer 100 engages with the passage 200 to hold the firearm obstructer 100 in place in the passage 200. The firearm obstructer 100 so positioned provides an obstruction in the passage 200. In the unlocking configuration, the firearm obstructer 100 is removable from the passage 200. A method of operating the same is also provided.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A firearm obstructer suitable for use in obstructing a passage between a chamber and a muzzle of a firearm, the firearm obstructer comprising: an arm, and a body having a tapered region, wherein the arm is arranged to move relative to the tapered region to transition the firearm obstructer between locking and unlocking configurations, wherein in the locking configuration the firearm obstructer is arranged to engage with the passage to hold the firearm obstructer in place in the passage, and wherein the firearm obstructer so positioned provides an obstruction in the passage, wherein in the unlocking configuration the firearm obstructer is removable from the passage;

wherein the firearm obstructer has a wide portion and a narrow portion, the narrow portion comprising the body and the arm, wherein, in use, the narrow portion is inserted into the passage of the firearm and the wide portion is positioned outside of the passage of the firearm; and wherein the wide portion is connected to the narrow portion by a frangible connection arranged to break in response to a predetermined amount of force being applied to the wide portion, so as to separate the wide portion from the narrow portion such that, in use, the narrow portion may remain within the passage of the firearm.

2. A firearm obstructer suitable for use in obstructing a passage between a chamber and a muzzle of a firearm, the firearm obstructer comprising: an arm, and a body having a tapered region, wherein the arm is arranged to move relative to the tapered region to transition the firearm obstructer between locking and unlocking configurations, wherein in the locking configuration the firearm obstructer is arranged to engage with the passage to hold the firearm obstructer in place in the passage, and wherein the firearm obstructer so positioned provides an obstruction in the passage, and wherein in the unlocking configuration the firearm obstructer is removable from the passage;

further comprising a locking member, wherein rotation of the locking member causes relative movement of the arm and the tapered region, and wherein rotation of the locking member in one direction causes relative movement of the arm and the tapered region to transition the firearm obstructer to the locking configuration, whereas rotation of the locking member in an opposite direction allows the firearm obstructer to transition to the unlocking configuration;

wherein the locking member is connected to the arm so as to cause the relative movement between the arm and the tapered region, and wherein the connection between the locking member and the arm is arranged to break in response to a predetermined amount of force being applied to the connection so as to separate the locking member from the arm, wherein the locking member is optionally connected to the arm by one or more shear pins.

3. A firearm obstructer as claimed in claim 2, wherein the locking member cooperates with a key such that rotation of the key rotates the locking member.

4. A firearm obstructer as claimed in claim 2, further comprising an advancer, wherein the advancer connects the arm to the locking member, and wherein the connection between the arm and the advancer is arranged to break in response to the predetermined amount of force being applied to the connection so as to separate the advancer from the arm.

5. A firearm obstructer as claimed in claim 2, wherein the locking member comprises a threaded shaft.

6. A firearm obstructer suitable for use in obstructing a passage between a chamber and a muzzle of a firearm, the firearm obstructer comprising: an arm, and a body having a tapered region, wherein the arm is arranged to move relative to the tapered region to transition the firearm obstructer between locking and unlocking configurations, wherein in the locking configuration the firearm obstructer is arranged to engage with the passage to hold the firearm obstructer in place in the passage, and wherein the firearm obstructer so positioned provides an obstruction in the passage, and wherein in the unlocking configuration the firearm obstructer is removable from the passage;

wherein the body comprises a first body having the tapered region and a second body, wherein during normal use the second body and the first body remain at a fixed position relative to one another; and wherein the first body has an end portion defining an aperture sized to receive the second body, and wherein in response to a predetermined amount of force being applied to the second body, the second body is arranged to be driven into the aperture such that the second body is at least partially retained within the aperture of the first body.

7. A firearm obstructer as claimed in claim 6, wherein the end portion is in the form of a collet, wherein when the second body is driven into the aperture of the collet, the collet expands outwardly to form a locking configuration, and wherein in the locking configuration, the outer surface of the collet is arranged to engage the passage of the firearm to hold the firearm obstructer in position with the passage and wherein the firearm obstructer so positioned provides an obstruction in the passage.

8. A firearm obstructer as claimed in claim 7, wherein an outer surface of the second body is tapered, such that as the second body is driven further into the aperture of the collet, the collect expands further outwardly to form a tighter locking configuration.

9. A firearm obstructer suitable for use in obstructing a passage between a chamber and a muzzle of a firearm, the firearm obstructer comprising: an arm, and a body having a tapered region, wherein the arm is arranged to move relative to the tapered region to transition the firearm obstructer between locking and unlocking configurations, wherein in the locking configuration the firearm obstructer is arranged to engage with the passage to hold the firearm obstructer in place in the passage, and wherein the firearm obstructer so positioned provides an obstruction in the passage, and wherein in the unlocking configuration the firearm obstructer is removable from the passage;

further comprising a container containing an adhesive material, wherein the container is arranged to rupture in response to a predetermined amount of force being applied to the container such that the adhesive contained within the container is released so as to adhesively bond the firearm obstructer in position.

* * * * *